US005538289A

United States Patent [19]

Cassis, III

[11] Patent Number: 5,538,289

[45] Date of Patent: Jul. 23, 1996

[54] REMOVABLE TAG FOR DISPLAYING PRINTED INFORMATION

[76] Inventor: Joseph A. Cassis, III, 2540 Falcon Dr. NE., Cedar Rapids, Iowa 52402

[21] Appl. No.: 394,904

[22] Filed: Feb. 27, 1995

[51] Int. Cl.[6] ..... B42D 15/00

[52] U.S. Cl. ..... 283/74; 283/79; 283/55; 40/640

[58] Field of Search ..... 283/74, 75, 79, 283/80, 81, 55, 117; 40/299, 329, 633, 6, 636, 640

[56] References Cited

U.S. PATENT DOCUMENTS 3,228,129 1/1966 Gwinn et al. ..... 283/80 X
3,994,085 11/1976 Groselak et al. ..... 283/80 X
4,865,352 9/1989 Gollon ..... 283/74
5,366,249 11/1994 Diemert ..... 283/80

*Primary Examiner*—Willmon Fridie, Jr
*Attorney, Agent, or Firm*—James C. Nemmers

[57] ABSTRACT

A tag for removable attachment to the strap of a cap, handbag, luggage, carrying case, etc. or to belt loops of wearing apparel to display a message or advertising. The tag is made from commercially available coated heavy paper that is ultra-smooth, nonporous, highly durable, and moisture and tear resistant. Papers of this type can be imprinted in multiple colors using conventional printing methods. The tag is appropriately scored for easy folding and is notched on opposite sides which allows the article to be attached in a vertical orientation to belt loops and the like, as well as having the capability of being attached in a horizontal or random orientation to any type of strap.

8 Claims, 2 Drawing Sheets

FIG. 1
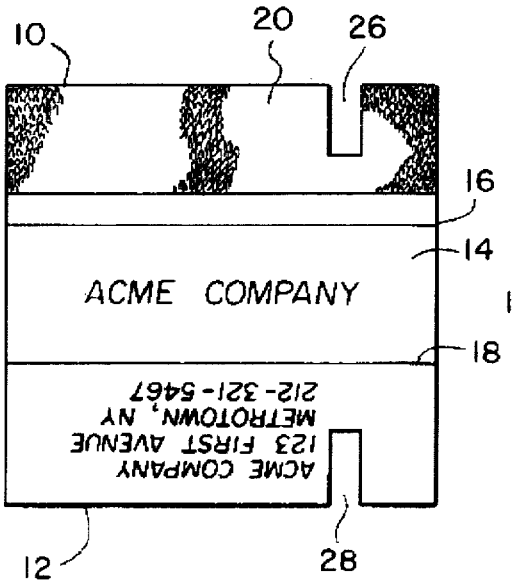
FIG. 2
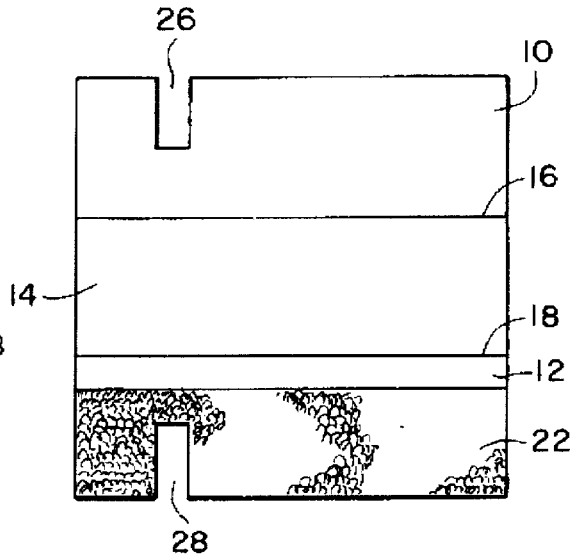
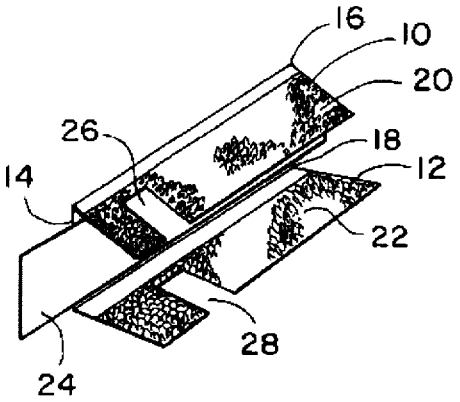
FIG. 3
FIG. 4
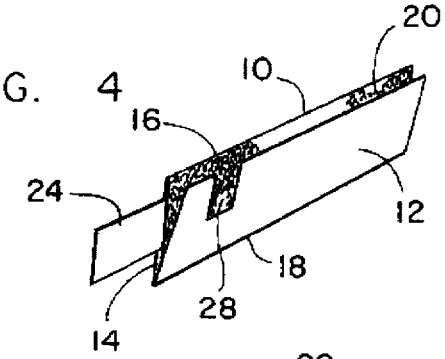
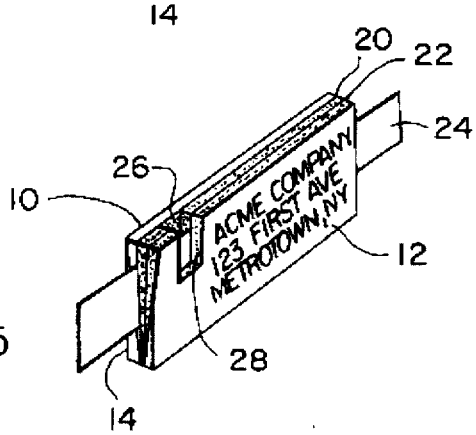
FIG. 5

FIG. 6
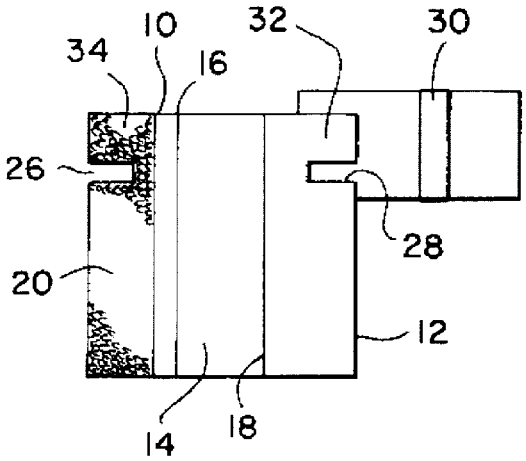
FIG. 7
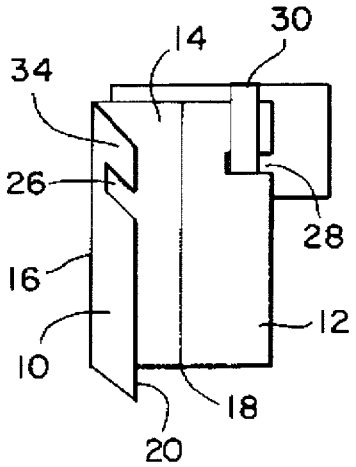
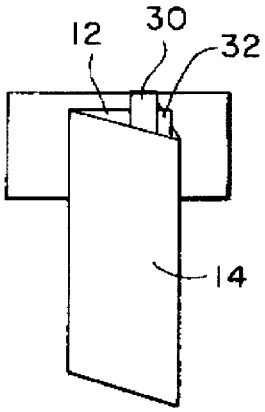
FIG. 8
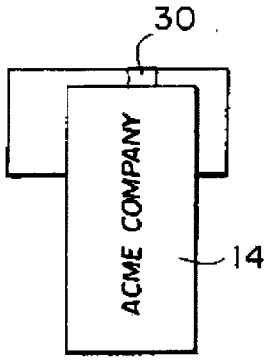
FIG. 9

REMOVABLE TAG FOR DISPLAYING PRINTED INFORMATION

BACKGROUND OF THE INVENTION

In recent times, there have appeared on the market tags that can be attached to a strap, such as the adjustable strap on the back of a cap, for example. The primary purpose of these tags is for the display of printed information, such as advertising. The known tags are made of a relatively heavy cloth material which is wrapped around the strap, folded over it and then joined by a suitable fastener such as Velcro material. When thus applied to the strap of a cap, approximately one-third of the tag will be visible, this one-third being approximately the width of the strap. It is on this visible portion of the tag that information, such as advertising, can be printed. Because of the use of a fastener, the tag can be removed and repeatedly fastened to the strap.

Known articles of this type have a number of deficiencies. Because the material is generally a heavy cloth material, any printing on the material must be done by a screen printing process which is relatively expensive and which does not equal the quality of commercial printing. Moreover, depending upon the type of material used, the imprinting can bleed into the material and not produce a sharp clear printing of the message desired. Also, because of being cut from cloth or similar material, the edges must be properly stitched to minimize the unraveling along the edges of the material. Furthermore, because of the particular design of known articles, they are principally useable only on cap straps in which printing on the display portion of the tag or article will appear horizontal when affixed to the strap of the cap. There is no provision in the known article to provide for attachment to a vertical strap such as a belt loop.

There is therefore a need for an improved article of this type which can more easily have the desired message imprinted on it at a lower cost and which will have a higher quality of printing at a lower cost. There is a further need for an improved article of this type which can be attached so as to display the message in a vertical position, such as attachment to a belt loop on slacks or trousers.

SUMMARY OF THE INVENTION

The improved article of the invention is made from coated heavy paper that is ultra-smooth and nonporous. Papers of this type are commercially available in various weights, and are highly durable, moisture and tear resistant, and can be imprinted in multiple colors using conventional printing methods. The article is appropriately notched on opposite sides which allows the article to be attached in a vertical orientation to belt loops and the like, as well as having the capability of being attached in a horizontal orientation.

BRIEF DESCRIPTION OF THE DRAWING

FIG. 1 is a front view of an article constructed according to the principles of the invention, the article being shown in a flat condition before attachment to a strap;

FIG. 2 is a rear view of the article of FIG. 1;

FIG. 3 is a perspective view illustrating the first step in attaching the article to a strap for horizontal orientation;

FIG. 4 is a perspective view illustrating the second step of application of the article to a strap;

FIG. 5 is a perspective view showing the article as attached to a strap;

FIG. 6 is a rear view of the article of FIGS. 1 and 2 and showing the first step in attaching the article to a belt loop for vertical orientation;

FIG. 7 is a view illustrating the second step of attaching the article to a vertical belt loop;

FIG. 8 is a view illustrating the next step in attaching the article for vertical orientation; and FIG. 9 is a view showing the article completely attached for vertical orientation.

DESCRIPTION OF THE PREFERRED EMBODIMENT OF THE INVENTION

FIGS. 1–5 of the drawings show the article of the invention and its method of attachment when used to attach the article to a strap for horizontal orientation. Referring first to FIGS. 1 and 2, the article is generally rectangular in shape, being cut from a suitable material such as a heavy coated synthetic paper that has a smooth finish and is nonporous. Such papers are commercially available in different colors, weights and materials. These papers are resistant to moisture and stains, are extremely tear resistant, and can be imprinted using any conventional printing methods. The article has an upper segment 10 and a lower segment 12 defining a middle panel 14. A score line 16 defines the upper segment 10 while a score line 18 defines the lower segment 12. This scoring permits the article to be easily folded consistently at the same place. FIG. 1 is a front view, the front being the side that is printed with the appropriate message, such as an advertising message, company name and logo, etc. As illustrated in FIG. 1, the principal area for the printed message is the front of the panel 14, although the front surface of the lower segment may also be imprinted as illustrated in FIG. 1 as well as the rear surface of the upper segment 10 for instructions or additional promotional information.

The front surface of the upper segment 10 provides a surface for a fastener 20 which can be any suitable type of fastener. Preferably, the fastener 20 on the upper segment 10 is a strip or buttons of material with an adhesive backing that is the hook portion of Velcro material. On the rear of the lower segment 12 there is a corresponding strip or buttons of the loop portion of the Velcro material. Although Velcro material is illustrated in the preferred embodiment because of its low cost, ease of attachment and other desired properties, it should be understood that any suitable fastening means, such as snap fasteners, could also be used as long as the fastener provides for the repeated attachment to and removal of the article of the invention from a strap or loop.

FIG. 3 illustrates the first step in attaching the article of the invention to a strap 24, such as the adjustable strap on the rear of a cap. Strap 24 could also be the strap on a handbag, piece of luggage, etc. In FIG. 3, the article is positioned with the rear surface resting against the outside of the strap so that the front surface of the panel 14 will face outwardly. The upper segment is then folded downwardly along the score line 16 so that its rear surface is adjacent the rear of the strap 24. The lower segment 10 is then folded along score line 18 upwardly until the fastener 22 on the lower surface engages the fastener 20 on the upper surface as seen in FIG. 4. The fasteners are then squeezed together to hold the article on the strap 24. FIG. 5 illustrates the article as attached to the strap 24 with the front surface of the panel 14 facing outwardly from the strap while the front surface of the lower segment 12 faces rearwardly. The imprinting on the front surface of the lower segment 12 is shown in FIG. 5 while the imprinting on the panel 14 is not shown. In most instances, the printing on the front surface of the lower segment 12 will not be visible if the article is attached to the rear strap of a cap since the lower segment 12 containing the printing will be inside of the cap against the head of the wearer. Although FIG. 5 for purposes of illustration shows the article as being relatively thick, the material from which the article is made is thin material, and attachment of the article to the rear strap of a cap does not interfere in any way with wearing of the cap or lessen the comfort of wearing the cap. In fact, the article of the invention may provide some cushion between the strap and the head of the wearer.

Referring now to FIGS. 6 through 9, there are illustrated the steps of applying the article of the invention to a vertical strap such as a belt loop for trousers or slacks. The article contains a notch 26 formed in the upper segment 10 and a notch 28 extending into the lower segment 12. Notches 26 and 28 are in alignment, so that when the upper segment 10 is folded along the score line 16 and the lower segment 12 is folded along the score line 18, that the notches 26 and 28 will overlie each other. This is illustrated in FIG. 5 which shows the article in use on a horizontal application for which the notches 26 and 28 are not used. When the article is to be applied for vertical orientation, such as by attachment to a belt loop 30, it is first rotated 90° from the orientation for a horizontal application that is shown in FIGS. 1–5. The article is then positioned with the rear surface adjacent the belt loop and the front surface facing outwardly. As shown in FIG. 7, the narrow portion 32 formed in the lower segment 12 by the notch 28 is slipped behind the belt loop 30 thus positioning the belt loop 30 in the notch 28. The article is then folded along both the score line 16 and the score line 18 until the narrow portion 34 of the upper segment 10 extends behind the narrow portion 32 of lower segment 12 with the belt loop 30 extending through the notch 26. This is illustrated in FIG. 8. When the upper segment 10 is then fully seated and positioned behind the lower segment 12, the fasteners 20 and 22 are engaged to hold the article in place in the vertical orientation as shown in FIG. 9. In this orientation, the front surface of panel 14 faces outwardly away from the wearer, thus displaying the message imprinted on the panel 14.

Although the use of the article has been described in connection with its application to the back strap of a cap for a horizontal orientation and to the belt loop of trousers or slacks for a vertical orientation, it will be understood that the article can be applied to any number of belts, straps, etc. commonly found on a variety of items. The addition of the notches 26 and 28 provides maximum flexibility in the application of the article to a variety of situations in which it is desired to display a message for advertising, the wearer's name or employer, etc. Because the material from which the article is made is a synthetic coated paper upon which printing can be made using any conventional printing technique, there are unlimited messages and colors that can be imprinted on the article with a resulting high quality appearance. In addition, the message on the display panel of the article can be imprinted using reflective inks or the panel can be covered with a hologram or highly reflective material and used as a safety device for children, joggers, police, etc. In any of the possible forms, the article can be produced at a relatively low cost making it readily available for a variety of applications and uses.

Having thus described the invention in connection with the preferred embodiments thereof, it will be evident to those skilled in the art that various revisions and modifications can be made to the preferred embodiments described herein without departing from the spirit and scope of the invention. It is my intention, however, that all such revisions and modifications that are obvious to persons skilled in the art will be included within the scope of the following claims.

What is claimed is as follows:

1. A removable and reusable article for displaying information by attachment to a strap or belt loop and the like, said article comprising a tag of thin material having a front surface and a rear surface and formed from coated nonporous synthetic paper having a smooth finish on the front surface, said tag having outer edges defining the shape of the tag, a first score line extending from opposite edges and spaced from an edge to form a first outer segment, a second score line extending from opposite edges generally parallel to the first score line and spaced from the first score line to form a second outer segment, the first and second score lines also forming a panel between them with the front surface of the panel suitable for printing and displaying information, a first part of a rejoinable fastening means combined with the first outer segment on the front surface of the tag, and a second part of a rejoinable fastening means combined with the second outer segment on the rear surface of the tag, thereby providing for folding of the first outer segment toward the rear surface along the first score line and folding of the second outer segment toward the rear surface along the second score line so as to removably join the first and second parts of the fastening means around the strap to which the tag is to be attached with the strap being captured behind the panel and between the outer segments with the front surface of the panel visible.

2. The article of claim 1 in which the tag is rectangular in shape with opposite edges substantially parallel, and the first and second score lines are parallel to two of the opposite edges and define a rectangular panel between them.

3. The article of claim 1 in which the fastening means is Velcro material.

4. The article of claim 1 in which the panel is covered with a reflective material.

5. A removable article for displaying information by attachment to a strap or belt loop and the like, said article comprising a tag of thin material having a front surface and a rear surface and formed from coated nonporous synthetic paper having a smooth finish on the front surface, said tag having outer edges defining the shape of the tag, a first score line extending from opposite edges and spaced from an edge to form a first outer segment, a second score line extending from opposite edges generally parallel to the first score line and spaced from the first score line to form a second outer segment, the first and second score lines also forming a panel between them, the first and second outer segments each having a notch extending inwardly from an edge toward and transversely to the score lines forming the outer segments, the notches being aligned so that when the outer segments are folded along their respective score lines toward the rear surface until the outer segments overlap the notches will overlie each other, a first part of a fastening means combined with the first outer segment on the front surface of the tag, and a second part of a fastening means combined with the second outer segment on the rear surface of the tag, thereby providing for folding of the first outer segment toward the rear surface along the first score line and folding of the second outer segment toward the rear surface along the second score line so as to join the first and second parts of the fastening means with the strap to which the tag is to be attached being captured behind the panel and between the outer segments with the front surface of the panel visible.

6. The article of claim 5 in which the fastening means is Velcro material.

7. The article of claim 5 in which the panel is imprinted with a desired message.

8. The article of claim 5 in which the panel is covered with a reflective material.

* * * * *